US007600395B2

(12) United States Patent
Eaton et al.

(10) Patent No.: US 7,600,395 B2
(45) Date of Patent: Oct. 13, 2009

(54) LNG SYSTEM EMPLOYING REFLUXED HEAVIES REMOVAL COLUMN WITH OVERHEAD CONDENSING

(75) Inventors: Anthony P. Eaton, Sugar Lane, TX (US); Bobby D. Martinez, Missouri City, TX (US); Jame Yao, Sugar Land, TX (US)

(73) Assignee: ConocoPhillips Company, Houston, TX (US)

( * ) Notice: Subject to any disclaimer, the term of this patent is extended or adjusted under 35 U.S.C. 154(b) by 842 days.

(21) Appl. No.: 10/875,734

(22) Filed: Jun. 24, 2004

(65) Prior Publication Data

US 2005/0284176 A1 Dec. 29, 2005

(51) Int. Cl.
*F25J 1/00* (2006.01)
*F25J 3/00* (2006.01)

(52) U.S. Cl. ..... 62/612; 62/620; 62/625

(58) Field of Classification Search ..... 62/612, 62/620, 611, 613, 628, 623, 50.2, 622, 24, 62/25, 39.02, 625; 48/127.3
See application file for complete search history.

(56) References Cited

U.S. PATENT DOCUMENTS

| | | | | |
|---|---|---|---|---|
| 3,721,099 | A * | 3/1973 | Forg et al. | 62/612 |
| 5,325,673 | A | 7/1994 | Durr et al. | |
| 5,498,317 | A * | 3/1996 | Holiday | 202/154 |
| 5,724,833 | A | 3/1998 | Devers | |
| 5,950,453 | A | 9/1999 | Bowen et al. | |
| 6,112,549 | A | 9/2000 | Yao et al. | |
| 6,401,486 | B1 | 6/2002 | Lee et al. | |
| 6,453,698 | B2 | 9/2002 | Jain et al. | |
| 6,662,589 | B1 * | 12/2003 | Roberts et al. | 62/425 |
| 6,691,531 | B1 * | 2/2004 | Martinez et al. | 62/612 |
| 6,925,837 | B2 * | 8/2005 | Eaton | 62/612 |
| 2003/0089125 | A1 * | 5/2003 | Fredheim et al. | 62/612 |
| 2005/0279131 | A1 * | 12/2005 | Battiste et al. | 62/611 |
| 2005/0279132 | A1 * | 12/2005 | Eaton et al. | 62/613 |

* cited by examiner

*Primary Examiner*—William C Doerrler

(57) ABSTRACT

A process and apparatus for the liquefaction of natural gas including an improved heavy hydrocarbon removal column with overhead condensing and refluxing. Particularly, a methane-rich stream exiting a propane refrigerant cycle is delivered to a heavies removal column, and the heavies depleted vapor from the column is at least partially condensed and the liquid portion provided as reflux to the heavies removal column.

36 Claims, 2 Drawing Sheets

LNG SYSTEM EMPLOYING REFLUXED HEAVIES REMOVAL COLUMN WITH OVERHEAD CONDENSING

BACKGROUND OF THE INVENTION

1. Field of the Invention

Figure 1:
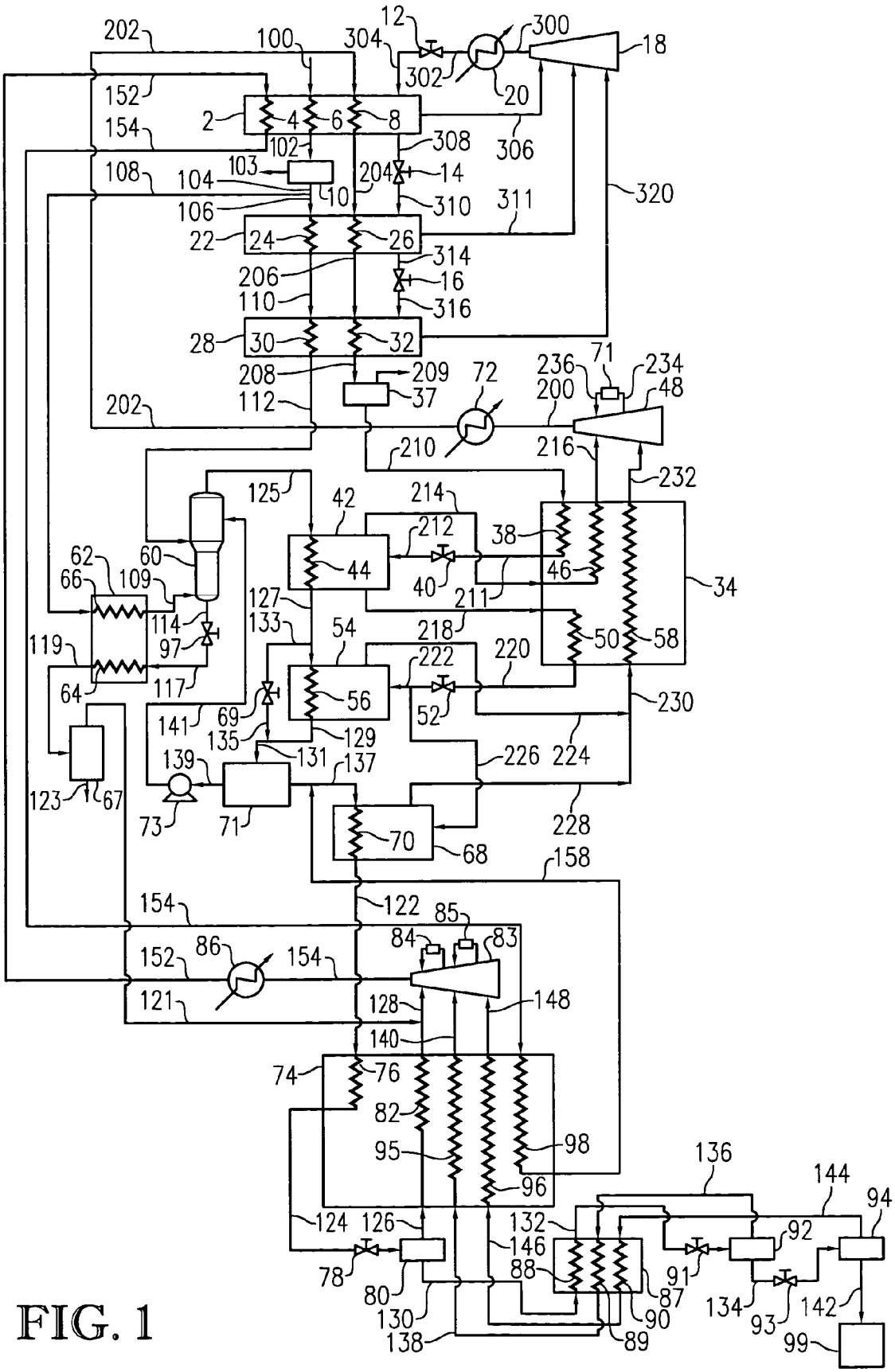

This invention relates to a method and apparatus for liquefying natural gas. In another aspect, the invention concerns an improved liquefied natural gas (LNG) facility employing a refluxed heavies removal column with overhead condensing.

2. Description of the Prior Art

The cryogenic liquefaction of natural gas is routinely practiced as a means of converting natural gas into a more convenient form for transportation and storage. Such liquefaction reduces the volume of the natural gas by about 600-fold and results in a product which can be stored and transported at near atmospheric pressure.

Natural gas is frequently transported by pipeline from the supply source to a distant market. It is desirable to operate the pipeline under a substantially constant and high load factor but often the deliverability or capacity of the pipeline will exceed demand while at other times the demand may exceed the deliverability of the pipeline. In order to shave off the peaks where demand exceeds supply or the valleys when supply exceeds demand, it is desirable to store the excess gas in such a manner that it can be delivered when demand exceeds supply. Such practice allows future demand peaks to be met with material from storage. One practical means for doing this is to convert the gas to a liquefied state for storage and to then vaporize the liquid as demand requires.

The liquefaction of natural gas is of even greater importance when transporting gas from a supply source which is separated by great distances from the candidate market and a pipeline either is not available or is impractical. This is particularly true where transport must be made by ocean-going vessels. Ship transportation in the gaseous state is generally not practical because appreciable pressurization is required to significantly reduce the specific volume of the gas. Such pressurization requires the use of more expensive storage containers.

In order to store and transport natural gas in the liquid state, the natural gas is preferably cooled to −240° F. to −260° F. where the liquefied natural gas (LNG) possesses a near-atmospheric vapor pressure. Numerous systems exist in the prior art for the liquefaction of natural gas in which the gas is liquefied by sequentially passing the gas at an elevated pressure through a plurality of cooling stages whereupon the gas is cooled to successively lower temperatures until the liquefaction temperature is reached. Cooling is generally accomplished by indirect heat exchange with one or more refrigerants such as propane, propylene, ethane, ethylene, methane, nitrogen, carbon dioxide, or combinations of the preceding refrigerants (e.g., mixed refrigerant systems). A liquefaction methodology which is particularly applicable to the current invention employs an open methane cycle for the final refrigeration cycle wherein a pressurized LNG-bearing stream is flashed and the flash vapors (i.e., the flash gas stream(s)) are subsequently employed as cooling agents, recompressed, cooled, combined with the processed natural gas feed stream and liquefied thereby producing the pressurized LNG-bearing stream.

Natural gas is primarily comprised of methane, but may also include lesser amounts of heavy hydrocarbon components. These heavy hydrocarbon components must be removed from the natural gas prior to liquefaction because if not removed, the heavy hydrocarbon components can freeze and foul downstream heat exchangers. Thus, most LNG facilities include one or more heavies removal columns for performing this function. Conventional heavies removal columns require operation within very narrow ranges of temperature, pressure, and feed composition in order to adequately removed heavy hydrocarbon components, while avoiding the removal of non-heavy components. In fact, a few degrees variation of feed temperature to a conventional heavies removal column could cause all the fluid in the column to turn to liquid, thereby requiring shutdown of the column. Thus, conventional LNG facilities must employ various expensive and time consuming measures to ensure that the heavies removal column(s) operate within certain narrow parameters.

OBJECTS AND SUMMARY OF THE INVENTION

It is, therefore, an object of the present invention to provide an LNG system with an improved heavies removal process employing overhead condensing and refluxing.

A further object of the invention is to provide a more flexible LNG system having broader tolerances allowing for greater variations in feed stream composition and operating conditions.

It should be understood that the above-listed objects are only exemplary, and not all the objects listed above need be accomplished by the invention described and claimed herein.

Accordingly, one aspect of the present invention concerns a method of liquefying natural gas comprising the steps of: (a) cooling an overheads stream from a heavies removal column via indirect heat exchange with a first refrigerant, thereby providing a cooled overheads stream; (b) separating the cooled overheads stream into a predominately liquid phase stream and a predominately gas phase stream; and (c) introducing at least a portion of the predominately liquid phase stream into the heavies removal column.

Another aspect of the present invention concerns a method of liquefying natural gas comprising the steps of: (a) cooling the natural gas via indirect heat exchange with a first refrigerant, thereby providing a cooled natural gas. stream; (b) using a heavies removal column to separate the cooled natural gas stream into a lights stream and a heavies stream; (c) cooling at least a portion of the lights stream via indirect heat exchange with a second refrigerant of different composition than the first refrigerant, thereby providing a cooled lights stream; (d) separating the cooled lights stream into a predominately liquid phase lights stream and a predominately gas phase lights stream; and (e) introducing at least a portion of the predominately liquid phase lights stream into the heavies removal column.

A further aspect of the present invention concerns a method of liquefying natural gas comprising the steps of: (a) cooling the natural gas in a first refrigeration cycle via indirect heat exchange with a first refrigerant comprising predominately propane, propylene, or carbon dioxide, thereby providing a first cooled natural gas stream; (b) using a heavies removal column to separate at least a portion of the cooled natural gas stream into a lights stream exiting an upper portion of the heavies removal column and a heavies stream exiting a lower portion of the heavies removal column; (c) cooling at least a portion of the lights stream in a second refrigeration cycle via indirect heat exchange with a second refrigerant comprising predominately ethane, ethylene, or carbon dioxide, thereby providing a cooled lights stream; (d) separating at least a portion of the cooled lights stream into a predominately liquid phase lights stream and a predominately gas phase lights stream; (e) cooling at least a portion of the predominately gas phase lights stream in the second refrigeration cycle via indirect heat exchange with the second refrigerant, thereby providing a second cooled natural gas stream; and (f) cooling at least a portion of the second cooled natural gas stream in a third refrigeration cycle via indirect heat exchange with a third refrigerant comprising predominately methane.

Still another aspect of the present invention concerns an apparatus for liquefying natural gas comprising: a first heat exchanger for cooling the natural gas via indirect heat exchange with a first refrigerant; a heavies removal column positioned downstream of the first heat exchanger and including a first inlet for receiving natural gas, the heavies removal column being operable to separate the natural gas into a lights stream and a heavies stream; a second heat exchanger for cooling the lights stream via indirect heat exchange with a second refrigerant; and a separator for separating the cooled stream from the second heat exchanger into a predominately gas phase lights stream and a predominately liquid phase lights stream, the heavies removal column including a second inlet for receiving the predominately liquid phase lights stream.

BRIEF DESCRIPTION OF THE DRAWING FIGURES

Figure 2:
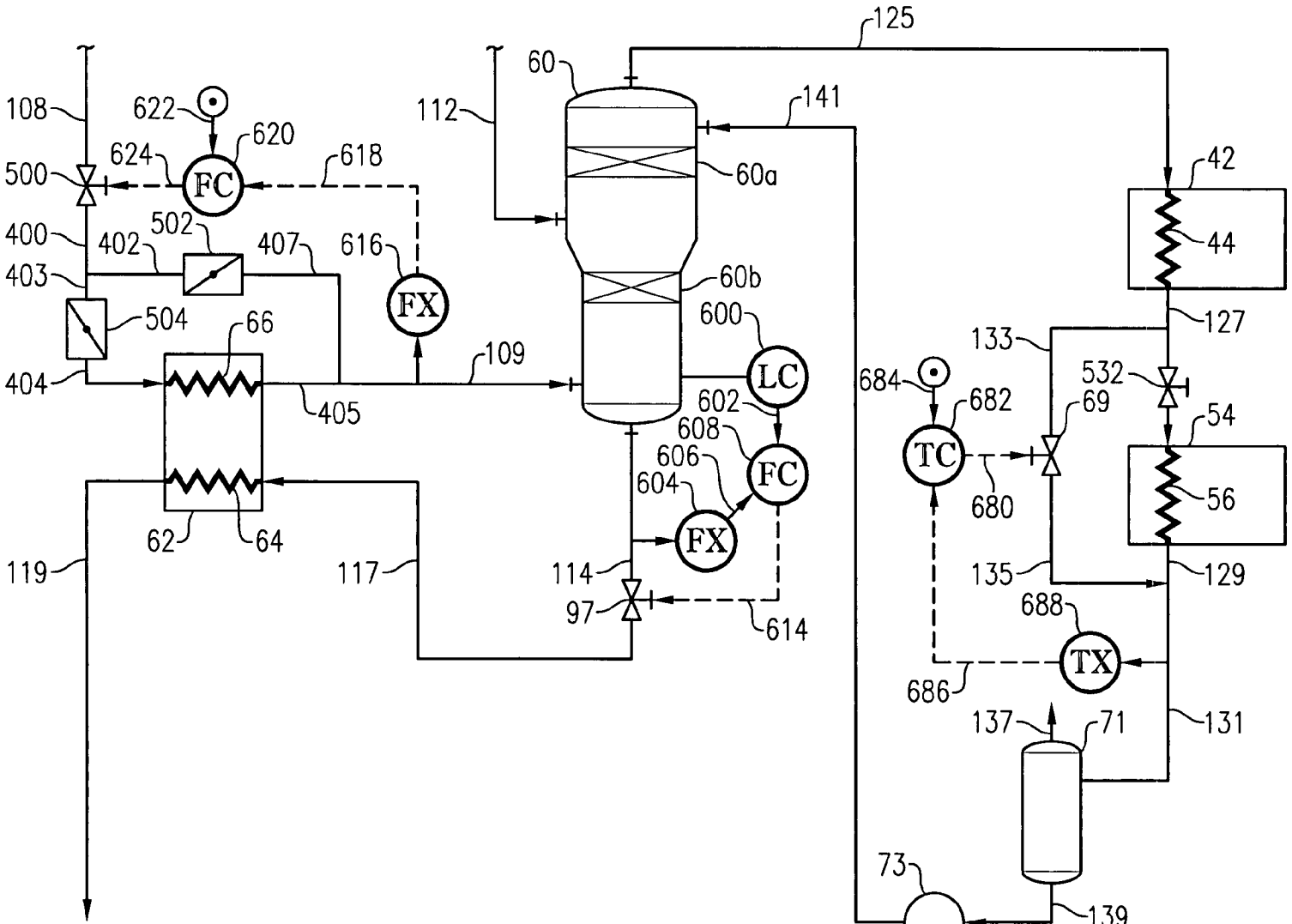

A preferred embodiment of the present invention is described in detail below with reference to the attached drawing figures, wherein:

FIG. 1 is a simplified flow diagram of a cascaded refrigeration process for LNG production employing a refluxed heavies removal column with overhead condensing; and FIG. 2 is a detailed view of a refluxed heavies removal column with overhead condensing and a preferred control system.

DETAILED DESCRIPTION OF THE PREFERRED EMBODIMENT

A cascaded refrigeration process uses one or more refrigerants for transferring heat energy from the natural gas stream to the refrigerant and ultimately transferring said heat energy to the environment. In essence, the overall refrigeration system functions as a heat pump by removing heat energy from the natural gas stream as the stream is progressively cooled to lower and lower temperatures. The design of a cascaded refrigeration process involves a balancing of thermodynamic efficiencies and capital costs. In heat transfer processes, thermodynamic irreversibilities are reduced as the temperature gradients between heating and cooling fluids become smaller, but obtaining such small temperature gradients generally requires significant increases in the amount of heat transfer area, major modifications to various process equipment, and the proper selection of flow rates through such equipment so as to ensure that both flow rates and approach and outlet temperatures are compatible with the required heating/cooling duty.

As used herein, the term "open-cycle cascaded refrigeration process" refers to a cascaded refrigeration process comprising at least one closed refrigeration cycle and one open refrigeration cycle where the boiling point of the refrigerant/cooling agent employed in the open cycle is less than the boiling point of the refrigerating agent or agents employed in the closed cycle(s) and a portion of the cooling duty to condense the compressed open-cycle refrigerant/cooling agent is provided by one or more of the closed cycles. In the current invention, a predominately methane stream is employed as the refrigerant/cooling agent in the open cycle. This predominantly methane stream originates from the processed natural gas feed stream and can include the compressed open methane cycle gas streams. As used herein, the terms "predominantly", "primarily", "principally", and "in major portion", when used to describe the presence of a particular component of a fluid stream, shall mean that the fluid stream comprises at least 50 mole percent of the stated component. For example, a "predominantly" methane stream, a "primarily" methane stream, a stream "principally" comprised of methane, or a stream comprised "in major portion" of methane each denote a stream comprising at least 50 mole percent methane.

One of the most efficient and effective means of liquefying natural gas is via an optimized cascade-type operation in combination with expansion-type cooling. Such a liquefaction process involves the cascade-type cooling of a natural gas stream at an elevated pressure, (e.g., about 650 psia) by sequentially cooling the gas stream via passage through a multistage propane cycle, a multistage ethane or ethylene cycle, and an open-end methane cycle which utilizes a portion of the feed gas as a source of methane and which includes therein a multistage expansion cycle to further cool the same and reduce the pressure to near-atmospheric pressure. In the sequence of cooling cycles, the refrigerant having the highest boiling point is utilized first followed by a refrigerant having an intermediate boiling point and finally by a refrigerant having the lowest boiling point. As used herein, the terms "upstream" and "downstream" shall be used to describe the relative positions of various components of a natural gas liquefaction plant along the flow path of natural gas through the plant.

Various pretreatment steps provide a means for removing certain undesirable components, such as acid gases, mercaptan, mercury, and moisture from the natural gas feed stream delivered to the LNG facility. The composition of this gas stream may vary significantly. As used herein, a natural gas stream is any stream principally comprised of methane which originates in major portion from a natural gas feed stream, such feed stream for example containing at least 85 mole percent methane, with the balance being ethane, higher hydrocarbons, nitrogen, carbon dioxide, and a minor amount of other contaminants such as mercury, hydrogen sulfide, and mercaptan. The pretreatment steps may be separate steps located either upstream of the cooling cycles or located downstream of one of the early stages of cooling in the initial cycle. The following is a non-inclusive listing of some of the available means which are readily known to one skilled in the art. Acid gases and to a lesser extent mercaptan are routinely removed via a chemical reaction process employing an aqueous amine-bearing solution. This treatment step is generally performed upstream of the cooling stages in the initial cycle. A major portion of the water is routinely removed as a liquid via two-phase gas-liquid separation following gas compression and cooling upstream of the initial cooling cycle and also downstream of the first cooling stage in the initial cooling cycle. Mercury is routinely removed via mercury sorbent beds. Residual amounts of water and acid gases are routinely removed via the use of properly selected sorbent beds such as regenerable molecular sieves.

The pretreated natural gas feed stream is generally delivered to the liquefaction process at an elevated pressure or is compressed to an elevated pressure generally greater than 500 psia, preferably about 500 psia to about 3000 psia, still more preferably about 500 psia to about 1000 psia, still yet more preferably about 600 psia to about 800 psia. The feed stream temperature is typically near ambient to slightly above ambient. A representative temperature range being 60° F. to 150° F.

As previously noted, the natural gas feed stream is cooled in a plurality of multistage cycles or steps (preferably three) by indirect heat exchange with a plurality of different refrigerants (preferably three). The overall cooling efficiency for a given cycle improves as the number of stages increases but this increase in efficiency is accompanied by corresponding increases in net capital cost and process complexity. The feed gas is preferably passed through an effective number of refrigeration stages, nominally two, preferably two to four, and more preferably three stages, in the first closed refrigeration cycle utilizing a relatively high boiling refrigerant. Such relatively high boiling point refrigerant is preferably comprised in major portion of propane, propylene, or mixtures thereof, more preferably the refrigerant comprises at least about 75 mole percent propane, even more preferably at least 90 mole percent propane, and most preferably the refrigerant consists essentially of propane. Thereafter, the processed feed gas flows through an effective number of stages, nominally two, preferably two to four, and more preferably two or three, in a second closed refrigeration cycle in heat exchange with a refrigerant having a lower boiling point. Such lower boiling point refrigerant is preferably comprised in major portion of ethane, ethylene, or mixtures thereof, more preferably the refrigerant comprises at least about 75 mole percent ethylene, even more preferably at least 90 mole percent ethylene, and most preferably the refrigerant consists essentially of ethylene. Each cooling stage comprises a separate cooling zone. As previously noted, the processed natural gas feed stream is preferably combined with one or more recycle streams (i.e., compressed open methane cycle gas streams) at various locations in the second cycle thereby producing a liquefaction stream. In the last stage of the second cooling cycle, the liquefaction stream is condensed (i.e., liquefied) in major portion, preferably in its entirety, thereby producing a pressurized LNG-bearing stream. Generally, the process pressure at this location is only slightly lower than the pressure of the pretreated feed gas to the first stage of the first cycle.

Generally, the natural gas feed stream will contain such quantities of $C_2$+ components so as to result in the formation of a $C_2$+ rich liquid in one or more of the cooling stages. This liquid is removed via gas-liquid separation means, preferably one or more conventional gas-liquid separators. Generally, the sequential cooling of the natural gas in each stage is controlled so as to remove as much of the $C_2$ and higher molecular weight hydrocarbons as possible from the gas to produce a gas stream predominating in methane and a liquid stream containing significant amounts of ethane and heavier components. An effective number of gas/liquid separation means are located at strategic locations downstream of the cooling zones for the removal of liquids streams rich in $C_2$+ components. The exact locations and number of gas/liquid separation means, preferably conventional gas/liquid separators, will be dependant on a number of operating parameters, such as the $C_2$+ composition of the natural gas feed stream, the desired BTU content of the LNG product, the value of the $C_2$+ components for other applications, and other factors routinely considered by those skilled in the art of LNG plant and gas plant operation. The $C_2$+ hydrocarbon stream or streams may be demethanized via a single stage flash or a fractionation column. In the latter case, the resulting methane-rich stream can be directly returned at pressure to the liquefaction process. In the former case, this methane-rich stream can be repressurized and recycle or can be used as fuel gas. The $C_2$+ hydrocarbon stream or streams or the demethanized $C_2$+ hydrocarbon stream may be used as fuel or may be further processed, such as by fractionation in one or more fractionation zones to produce individual streams rich in specific chemical constituents (e.g., $C_2$, $C_3$, $C_4$ and $C_5$+).

The pressurized LNG-bearing stream is then further cooled in a third cycle or step referred to as the open methane cycle via contact in a main methane economizer with flash gases (i.e., flash gas streams) generated in this third cycle in a manner to be described later and via sequential expansion of the pressurized LNG-bearing stream to near atmospheric pressure. The flash gases used as a refrigerant in the third refrigeration cycle are preferably comprised in major portion of methane, more preferably the flash gas refrigerant comprises at least 75 mole percent methane, still more preferably at least 90 mole percent methane, and most preferably the refrigerant consists essentially of methane. During expansion of the pressurized LNG-bearing stream to near atmospheric pressure, the pressurized LNG-bearing stream is cooled via at least one, preferably two to four, and more preferably three expansions where each expansion employs an expander as a pressure reduction means. Suitable expanders include, for example, either Joule-Thomson expansion valves or hydraulic expanders. The expansion is followed by a separation of the gas-liquid product with a separator. When a hydraulic expander is employed and properly operated, the greater efficiencies associated with the recovery of power, a greater reduction in stream temperature, and the production of less vapor during the flash expansion step will frequently more than off-set the higher capital and operating costs associated with the expander. In one embodiment, additional cooling of the pressurized LNG-bearing stream prior to flashing is made possible by first flashing a portion of this stream via one or more hydraulic expanders and then via indirect heat exchange means employing said flash gas stream to cool the remaining portion of the pressurized LNG-bearing stream prior to flashing. The warmed flash gas stream is then recycled via return to an appropriate location, based on temperature and pressure considerations, in the open methane cycle and will be recompressed.

The liquefaction process described herein may use one of several types of cooling which include but are not limited to (a) indirect heat exchange, (b) vaporization, and (c) expansion or pressure reduction. Indirect heat exchange, as used herein, refers to a process wherein the refrigerant cools the substance to be cooled without actual physical contact between the refrigerating agent and the substance to be cooled. Specific examples of indirect heat exchange means include heat exchange undergone in a shell-and-tube heat exchanger, a core-in-kettle heat exchanger, and a brazed aluminum plate-fin heat exchanger. The physical state of the refrigerant and substance to be cooled can vary depending on the demands of the system and the type of heat exchanger chosen. Thus, a shell-and-tube heat exchanger will typically be utilized where the refrigerating agent is in a liquid state and the substance to be cooled is in a liquid or gaseous state or when one of the substances undergoes a phase change and process conditions do not favor the use of a core-in-kettle heat exchanger. As an example, aluminum and aluminum alloys are preferred materials of construction for the core but such materials may not be suitable for use at the designated process conditions. A plate-fin heat exchanger will typically be utilized where the refrigerant is in a gaseous state and the substance to be cooled is in a liquid or gaseous state. Finally, the core-in-kettle heat exchanger will typically be utilized where the substance to be cooled is liquid or gas and the refrigerant undergoes a phase change from a liquid state to a gaseous state during the heat exchange.

Vaporization cooling refers to the cooling of a substance by the evaporation or vaporization of a portion of the substance with the system maintained at a constant pressure. Thus, during the vaporization, the portion of the substance which evaporates absorbs heat from the portion of the substance which remains in a liquid state and hence, cools the liquid portion. Finally, expansion or pressure reduction cooling refers to cooling which occurs when the pressure of a gas, liquid or a two-phase system is decreased by passing through a pressure reduction means. In one embodiment, this expansion means is a Joule-Thomson expansion valve. In another embodiment, the expansion means is either a hydraulic or gas expander. Because expanders recover work energy from the expansion process, lower process stream temperatures are possible upon expansion.

The flow schematic and apparatus set forth in FIG. 1 represents a preferred embodiment of the inventive LNG facility employing a heavies removal column with overhead condensing and reflux. FIG. 2 represents a preferred embodiment of the heavies removal column with overhead condensing and apparatus for refluxing a portion of the heavies depleted stream back to the heavies removal column. Those skilled in the art will recognize that FIGS. 1 and 2 are schematics only and, therefore, many items of equipment that would be needed in a commercial plant for successful operation have been omitted for the sake of clarity. Such items might include, for example, compressor controls, flow and level measurements and corresponding controllers, temperature and pressure controls, pumps, motors, filters, additional heat exchangers, and valves, etc. These items would be provided in accordance with standard engineering practice.

To facilitate an understanding of FIGS. 1 and 2, the following numbering nomenclature was employed. Items numbered 1 through 99 are process vessels and equipment which are directly associated with the liquefaction process. Items numbered 100 through 199 correspond to flow lines or conduits which contain predominantly methane streams. Items numbered 200 through 299 correspond to flow lines or conduits which contain predominantly ethylene streams. Items numbered 300 through 399 correspond to flow lines or conduits which contain predominantly propane streams. Items numbered 400 through 499 in FIG. 2 correspond to additional flow lines or conduits. Items numbered 500 though 599 in FIG. 2 correspond to additional process equipment such as valves of the heavies removal system. Items numbered 600 through 699 in FIG. 2 generally concern the process control system, exclusive of control valves, and specifically includes sensors, transducers, controllers and setpoint inputs.

Referring to FIG. 1, gaseous propane is compressed in a multistage (preferably three-stage) compressor 18 driven by a gas turbine driver (not illustrated). The three stages of compression preferably exist in a single unit although each stage of compression may be a separate unit and the units mechanically coupled to be driven by a single driver or combination of drivers. Upon compression, the compressed propane is passed through conduit 300 to a cooler 20 where it is cooled and liquefied. A representative pressure and temperature of the liquefied propane refrigerant prior to flashing is about 100° F. and about 190 psia. The stream from cooler 20 is passed through conduit 302 to a pressure reduction means, illustrated as expansion valve 12, wherein the pressure of the liquefied propane is reduced, thereby evaporating or flashing a portion thereof. The resulting two-phase product then flows through conduit 304 into a high-stage propane chiller 2 wherein gaseous methane refrigerant introduced via conduit 152, natural gas feed introduced via conduit 100, and gaseous ethylene refrigerant introduced via conduit 202 are respectively cooled via indirect heat exchange means 4,6, and 8, thereby producing cooled gas streams respectively produced via conduits 154, 102, and 204. The gas in conduit 154 is fed to a main methane economizer 74 which will be discussed in greater detail in a subsequent section and wherein the stream is cooled via indirect heat exchange means 98. The resulting cooled compressed methane recycle stream produced via conduit 158 is then combined in conduit 137 with the heavies depleted (i.e., light-hydrocarbon rich) predominantly gas phase stream from a liquid-vapor separator 71 and fed to an ethylene chiller 68.

The propane gas from chiller 2 is returned to compressor 18 through conduit 306. This gas is fed to the high-stage inlet port of compressor 18. The remaining liquid propane is passed through conduit 308, the pressure further reduced by passage through a pressure reduction means, illustrated as expansion valve 14, whereupon an additional portion of the liquefied propane is flashed. The resulting two-phase stream is then fed to an intermediate stage propane chiller 22 through conduit 310, thereby providing a coolant for chiller 22. The cooled feed gas stream from chiller 2 flows via conduit 102 to separation equipment 10 wherein gas and liquid phases are separated. The liquid phase, which can be rich in $C_3$+ components, is removed via conduit 103. The gaseous phase is removed via conduit 104 and then split into two separate streams which are conveyed via conduits 106 and 108. The stream in conduit 106 is fed to propane chiller 22. The stream in conduit 108 becomes the feed to heat exchanger 62 and ultimately becomes the stripping gas to heavies removal column 60, discussed in more detail below. Ethylene refrigerant from chiller 2 is introduced to chiller 22 via conduit 204. In chiller 22, the feed gas stream, also referred to herein as a methane-rich stream, and the ethylene refrigerant streams are respectively cooled via indirect heat transfer means 24 and 26, thereby producing cooled methane-rich and ethylene refrigerant streams via conduits 110 and 206. The thus evaporated portion of the propane refrigerant is separated and passed through conduit 311 to the intermediate-stage inlet of compressor 18. Liquid propane refrigerant from chiller 22 is removed via conduit 314, flashed across a pressure reduction means, illustrated as expansion valve 16, and then fed to a low-stage propane chiller/condenser 28 via conduit 316.

As illustrated in FIG. 1, the methane-rich stream flows from intermediate-stage propane chiller 22 to the low-stage propane chiller 28 via conduit 110. In chiller 28, the stream is cooled via indirect heat exchange means 30. In a like manner, the ethylene refrigerant stream flows from the intermediate-stage propane chiller 22 to low-stage propane chiller 28 via conduit 206. In the latter, the ethylene refrigerant is totally condensed or condensed in nearly its entirety via indirect heat exchange means 32. The vaporized propane is removed from low-stage propane chiller 28 and returned to the low-stage inlet of compressor 18 via conduit 320.

As illustrated in FIG. 1, the methane-rich stream exiting low-stage propane chiller 28 is introduced into a heavies removal column 60. In heavies removal column 60, the feed stream introduced via conduit 112 is separated into a heavies-depleted vapor stream exiting column 60 via conduit 125 and a heavies-rich liquid stream exiting column 60 via conduit 114. As described in greater detail below with reference to FIG. 2, the removal of heavy components from the feed stream to the heavies removal column 60 is facilitated by the introduction of a stripping gas stream, via conduit 109, and a reflux stream, via conduit 141, into column 60. Locating heavies removal column 60 immediately downstream of low-stage propane chiller 28 widens the acceptable operating parameters of heavies removal column 60 compared to prior art systems. In the inventive configuration, heavies removal column 60 operates further away from the critical pressure of the overheads vapor stream in conduit 125. Preferably, the actual pressure at the top of heavies removal column 60 is at least 50 psi less than the critical pressure of the overheads stream in conduit 125, more preferably at least 75 psi less than the critical pressure of the overheads stream in conduit 125.

As previously noted, the methane-rich stream in line 104 was split so as to flow via conduits 106 and 108. The contents of conduit 108, which is referred to herein as the stripping gas, is first fed to heat exchanger 62 wherein this stream is cooled via indirect heat exchange means 66, thereby becoming a cooled stripping gas stream which then flows via conduit 109 to heavies removal column 60. A heavies-rich liquid stream containing a significant concentration of $C_4$+ hydrocarbons, such as benzene, cyclohexane, other aromatics, and/or heavier hydrocarbon components, is removed from heavies removal column 60 via conduit 114, preferably flashed via a flow control means 97, preferably a control valve which can also function as a pressure reduction means, and transported to heat exchanger 62 via conduit 117. Preferably, the stream flashed via flow control means 97 is flashed to a pressure about or greater than the pressure at the high stage inlet port to methane compressor 83. Flashing also imparts greater cooling capacity to the stream. In heat exchanger 62, the heavies-rich stream delivered by conduit 117 provides cooling capabilities via indirect heat exchange means 64 and exits heat exchanger 62 via conduit 119. The heavies-rich stream exiting heat exchanger 62 via conduit 119 is subsequently separated into liquid and vapor portions or preferably is flashed or fractionated in vessel 67. In either case, a heavies-rich liquid stream is produced via conduit 123 and a second methane-rich vapor stream is produced via conduit 121. In the preferred embodiment, which is illustrated in FIG. 1, the stream in conduit 121 is subsequently combined with a second stream delivered via conduit 128, and the combined stream fed to the high-stage inlet port of the methane compressor 83.

The heavies-depleted vapor stream exiting heavies removal column 60 via conduit 125 is fed to a high-stage ethylene chiller 42 for cooling via indirect heat exchange with a predominantly ethylene refrigerant. Ethylene refrigerant exits low-stage propane chiller 28 via conduit 208 and is preferably fed to a separation vessel 37 wherein light components are removed via conduit 209 and condensed ethylene is removed via conduit 210. The ethylene refrigerant at this location in the process is generally at a temperature of about −24° F. and a pressure of about 285 psia. The ethylene refrigerant then flows to an ethylene economizer 34 wherein it is cooled via indirect heat exchange means 38, removed via conduit 211, and passed to a pressure reduction means, illustrated as an expansion valve 40, whereupon the refrigerant is flashed to a preselected temperature and pressure and fed to high-stage ethylene chiller 42 via conduit 212. Vapor is removed from chiller 42 via conduit 214 and routed to ethylene economizer 34 wherein the vapor functions as a coolant via indirect heat exchange means 46. The ethylene vapor is then removed from ethylene economizer 34 via conduit 216 and fed to the high-stage inlet of ethylene compressor 48. The ethylene refrigerant which is not vaporized in high-stage ethylene chiller 42 is removed via conduit 218 and returned to ethylene economizer 34 for further cooling via indirect heat exchange means 50, removed from ethylene economizer via conduit 220, and flashed in a pressure reduction means, illustrated as expansion valve 52, whereupon the resulting two-phase product is introduced into an intermediate-stage ethylene chiller 54 via conduit 222.

After cooling in indirect heat exchange means 44 of high-stage ethylene chiller 42, the methane-rich stream is removed from high-stage ethylene chiller 42 via conduit 127. This stream is then condensed in part via cooling provided by indirect heat exchange means 56 in intermediate-stage ethylene chiller 54, thereby producing a two-phase stream which flows via conduit 129 and conduit 131 to a gas/liquid separator 71. The temperature of the methane-rich stream entering gas/liquid separator 71 maybe controlled using a by-pass valve 69 which diverts a portion of the methane stream around intermediate-stage ethylene chiller 54. A portion of the methane-rich stream in conduit 127 is diverted into conduit 133, through by-pass valve 69 and into conduit 135. The methane-rich streams of conduits 129 and 135 are combined in conduit 131 and directed to separator 71 for separation of the gas and liquid phases. The liquid phase exits separator 71 via conduit 139. A cryogenic pump 73 pumps the liquid methane-rich stream to heavies removal column 60 via conduit 141 where it is used as a reflux stream to enhance the removal of heavies from the feed stream entering column 60 via conduit 112.

As previously noted, the gas in conduit 154 is fed to main methane economizer 74 wherein the stream is cooled via indirect heat exchange means 98. The resulting cooled compressed methane recycle or refrigerant stream in conduit 158 is combined in the preferred embodiment with the heavies-depleted vapor stream from separator 71 delivered via conduit 137, and fed to a low-stage ethylene chiller 68. In low-stage ethylene chiller 68, this stream is cooled and condensed via indirect heat exchange means 70 with the liquid effluent from valve 52 which is routed to low-stage ethylene chiller 68 via conduit 226. The condensed methane-rich product from low-stage condenser 68 is produced via conduit 122. The vapor from intermediate-stage ethylene chiller 54, withdrawn via conduit 224, and low-stage ethylene chiller 68, withdrawn via conduit 228, are combined and routed, via conduit 230, to ethylene economizer 34 wherein the vapors function as a coolant via indirect heat exchange means 58. The stream is then routed via conduit 232 from ethylene economizer 34 to the low-stage inlet of ethylene compressor 48.

As noted in FIG. 1, the compressor effluent from vapor introduced via the low-stage side of ethylene compressor 48 is removed via conduit 234, cooled via inter-stage cooler 71, and returned to compressor 48 via conduit 236 for injection with the high-stage stream present in conduit 216. Preferably, the two-stages are a single module although they may each be a separate module and the modules mechanically coupled to a common driver. The compressed ethylene product from compressor 48 is routed to a downstream cooler 72 via conduit 200. The product from cooler 72 flows via conduit 202 and is introduced, as previously discussed, to high-stage propane chiller 2.

The pressurized LNG-bearing stream, preferably a liquid stream in its entirety, in conduit 122 is preferably at a temperature in the range of from about −200 to about −50° F., more preferably in the range of from about −175 to about −100° F., most preferably in the range of from −150 to −125° F. The pressure of the stream in conduit 122 is preferably in the range of from about 500 to about 700 psia, most preferably in the range of from 550 to 725 psia.

The stream in conduit 122 is directed to a main methane economizer 74 wherein the stream is further cooled by indirect heat exchange means/heat exchanger pass 76 as hereinafter explained. It is preferred for main methane economizer 74 to include a plurality of heat exchanger passes which provide for the indirect exchange of heat between various predominantly methane streams in the economizer 74. Preferably, methane economizer 74 comprises one or more plate-fin heat exchangers. The cooled stream from heat exchanger pass 76 exits methane economizer 74 via conduit 124. It is preferred for the temperature of the stream in conduit 124 to be at least about 10° F. less than the temperature of the stream in conduit 122, more preferably at least about 25° F. less than the temperature of the stream in conduit 122. Most preferably, the temperature of the stream in conduit 124 is in the range of from about −200 to about −160° F. The pressure of the stream in conduit 124 is then reduced by a pressure reduction means, illustrated as expansion valve 78, which evaporates or flashes a portion of the liquid stream thereby generating a two-phase stream. The two-phase stream from expansion valve 78 is then passed to high-stage methane flash drum 80 where it is separated into a flash gas stream discharged through conduit 126 and a liquid phase stream (i.e., pressurized LNG-bearing stream) discharged through conduit 130. The flash gas stream is then transferred to main methane economizer 74 via conduit 126 wherein the stream functions as a coolant in heat exchanger pass 82 and aids in the cooling of the stream in heat exchanger pass 76. Thus, the predominantly methane stream in heat exchanger pass 82 is warmed, at least in part, by indirect heat exchange with the predominantly methane stream in heat exchanger pass 76. The warmed stream exits heat exchanger pass 82 and methane economizer 74 via conduit 128. It is preferred for the temperature of the warmed predominantly methane stream exiting heat exchanger pass 82 via conduit 128 to be at least about 10° F. greater than the temperature of the stream in conduit 124, more preferably at least about 25° F. greater than the temperature of the stream in conduit 124. The temperature of the stream exiting heat exchanger pass 82 via conduit 128 is preferably warmer than about −50° F., more preferably warmer than about 0° F., still more preferably warmer than about 25° F., and most preferably in the range of from 40 to 100° F.

The liquid-phase stream exiting high-stage flash drum 80 via conduit 130 is passed through a second methane economizer 87 wherein the liquid is further cooled by downstream flash vapors via indirect heat exchange means 88. The cooled liquid exits second methane economizer 87 via conduit 132 and is expanded or flashed via pressure reduction means, illustrated as expansion valve 91, to further reduce the pressure and, at the same time, vaporize a second portion thereof. This two-phase stream is then passed to an intermediate-stage methane flash drum 92 where the stream is separated into a gas phase passing through conduit 136 and a liquid phase passing through conduit 134. The gas phase flows through conduit 136 to second methane economizer 87 wherein the vapor cools the liquid introduced to economizer 87 via conduit 130 via indirect heat exchanger means 89. Conduit 138 serves as a flow conduit between indirect heat exchange means 89 in second methane economizer 87 and heat exchanger pass 95 in main methane economizer 74. The warmed vapor stream from heat exchanger pass 95 exits main methane economizer 74 via conduit 140 and is conducted to the intermediate-stage inlet of methane compressor 83.

The liquid phase stream exiting intermediate-stage flash drum 92 via conduit 134 is further reduced in pressure by passage through a pressure reduction means, illustrated as a expansion valve 93. Again, a third portion of the liquefied natural gas is evaporated or flashed. The two-phase stream from expansion valve 93 are passed to a final or low-stage flash drum 94. In flash drum 94, a vapor phase is separated and passed through conduit 144 to second methane economizer 87 wherein the vapor functions as a coolant via indirect heat exchange means 90, exits second methane economizer 87 via conduit 146, which is connected to the first methane economizer 74 wherein the vapor functions as a coolant via heat exchanger pass 96. The warmed vapor stream from heat exchanger pass 96 exits main methane economizer 74 via conduit 148 and is conducted to the low-stage inlet of compressor 83.

The liquefied natural gas product from low-stage flash drum 94, which is at approximately atmospheric pressure, is passed through conduit 142 to a LNG storage tank 99. In accordance with conventional practice, the liquefied natural gas in storage tank 99 can be transported to a desired location (typically via an ocean-going LNG tanker). The LNG can then be vaporized at an onshore LNG terminal for transport in the gaseous state via conventional natural gas pipelines.

As shown in FIG. 1, the high, intermediate, and low stages of compressor 83 are preferably combined as single unit. However, each stage may exist as a separate unit where the units are mechanically coupled together to be driven by a single driver. The compressed gas from the low-stage section passes through an inter-stage cooler 85 and is combined with the intermediate pressure gas in conduit 140 prior to the second-stage of compression. The compressed gas from the intermediate stage of compressor 83 is passed through an inter-stage cooler 84 and is combined with the high pressure gas provided via conduits 121 and 128 prior to the third-stage of compression. The compressed gas (i.e., compressed open methane cycle gas stream) is discharged from high stage methane compressor through conduit 150, is cooled in cooler 86, and is routed to the high pressure propane chiller 2 via conduit 152 as previously discussed. The stream is cooled in chiller 2 via indirect heat exchange means 4 and flows to main methane economizer 74 via conduit 154. The compressed open methane cycle gas stream from chiller 2 which enters the main methane economizer 74 undergoes cooling in its entirety via flow through indirect heat exchange means 98. This cooled stream is then removed via conduit 158 and combined with the processed natural gas feed stream upstream of the low stage of ethylene cooling.

FIG. 2 illustrates a preferred embodiment of the system used to remove heavier hydrocarbon components from the methane-rich feed stream in conduit 112. Heavies removal column 60 includes upper internal packing 60*a* and lower internal packing 60*b*. Internal packing 60*a, b* divides heavies removal column into upper, middle, and lower zones. The two-phase feed stream is introduced into the middle zone of heavies removal column 60 via conduit 112. The stripping gas stream enters the lower zone of heavies removal column 60 via conduit 109. The liquid reflux stream enters the upper zone of heavies removal column 60 via conduit 141. Internal packing 60*a, b* is configured to enhance the countercurrent contacting of the various streams introduced into heavies removal column 60. This countercurrent contacting helps promote efficient removal of heavy hydrocarbon components from the feed stream so that a substantially heavies-free gas stream is discharged from column 60 via conduit 125 and a heavies-rich liquid stream is discharged via conduit 114.

It is preferred for the two-phase feed stream entering heavies removal column 60 via conduit 112 to have a temperature between about −10° F. and −60° F., more preferably between −20° F. and −40° F., and a pressure of about 600-700 psia, more preferably about 625-675 psia. The stripping gas stream entering heavies removal column 60 via conduit 109 preferably has a temperature that is at least 5° F. greater than the temperature of the feed stream entering via conduit 109. The liquid reflux stream entering heavies removal column 60 via conduit 141 preferably has a temperature that is at least 5° F. less than the temperature of the feed stream entering via conduit 109.

As illustrated in FIG. 2, the methane-rich stripping gas for use in heavies removal column 60 is initially delivered to the heavies removal system 60 via conduit 108. Although depicted in FIG. 1 as originating from the feed gas stream exiting the first stage of propane cooling, this stream can optionally originate from any location within the process or may be an outside methane-rich stream. As illustrated in FIG. 2, at least a portion of the methane-rich stripping gas undergoes cooling in heat exchanger 62 via indirect heat exchange means 66 prior to entering the base of column 60. The temperature and flow rate of the methane-rich stripping gas entering column 60 via conduit 109 may be controlled by various methodologies readily available to one skilled in the art. In a preferred embodiment, the methane-rich stripping gas stream delivered via conduit 108 flows through control valve 500 into conduit 400 whereupon the stream is split and transferred via conduits 402 and 403. The stream flowing through conduit 403 ultimately flows through indirect heat transfer means 66 in heat exchanger 62. A means for manipulating the relative flowrates of fluid in conduits 402 and 403 is provided in either conduits 402 or 403, or both. The means illustrated in FIG. 2 are simple hand control valves, designated 502 and 504, which are respectively attached to conduits 404 and 407. However, a control valve whose position is manipulated by a controller and for which input to the controller is comprised of a setpoint and signal representative of flow in the conduit, such as that discussed above for the heavies-bearing stream, may be substituted for one or both of the hand control valves. In any event, the valves are operated such that the temperature approach difference of the streams in conduits 117 and 404 to heat exchanger 62 does not exceed 50° F. whereupon damage to the heat exchanger might result. The cooled fluid leaves indirect heat transfer means 66 via conduit 405 and is combined at a junction point with uncooled methane-rich stripping gas delivered via conduit 407, thereby forming the cooled methane-rich stripping gas stream which is delivered to the column via conduit 109.

Operably located in conduit 109 is a flow transducing device 616 which in combination with a flow sensing device, such as an orifice plate (not illustrated), establishes an output signal 618 that typifies the actual flowrate of the fluid in the conduit. Signal 618 is provided as a process variable input to a flow controller 620. Also provided either manually or via computer output is a set point value for the flowrate represented by signal 622. The flow controller then provides an output signal 624 which is responsive to the difference between the respective input and setpoint signals and which is scaled to be representative of the position of the control valve required to maintain the desired flowrate in conduit 109.

In another embodiment, the relative flowrate of fluid through conduits 402 and 403 can be controlled via locating a temperature sensing device and a transducer connected to said device, if so required, in conduit 109 and using the resulting output and a setpoint temperature as input to a flow controller which would generate an output signal responsive to the difference in the two signals and scaled to be representative of a control valve position required to maintain the desired flowrate in conduit 109. Such control valves could be substituted for hand valves 502 and/or 504.

As illustrated in FIG. 2, the heavies-rich liquid stream produced via conduit 114 flows through control valve 97 and conduit 117 to heat exchanger 62 wherein said stream provides cooling via indirect heat transfer means 64 and is produced from heat exchanger 62 via conduit 119 as a warmed heavies-rich stream. Depending on the operational pressure of downstream processes, the cooling ability of this stream can be enhanced by flashing to a lower pressure upon flow through control valve 97. This process stream produced via conduit 119 may be utilized directly or undergo subsequent treatment for the removal of lighter components.

The flowrate of heavies-rich liquid from column 60 may be controlled via various methodologies readily available to one skilled in the art. The control apparatus illustrated in FIG. 2 is a preferred apparatus and is comprised of a level controller device 600, also a sensing device, and a signal transducer connected to said level controller device, operably located in the lower section of column 60. The controller 600 establishes an output signal 602 that either typifies the flowrate in conduit 114 required to maintain a desired level in column 60 or indicates that the actual level has exceeded a predetermined level. A flow measurement device and transducer 604 operably located in conduit 114 establishes an output signal 606 that typifies the actual flowrate of the fluid in conduit 114. The flow measurement device is preferably located upstream of the control valve so as to avoid sensing a two-phase stream. Signal 602 is provided as a set point signal to flow controller 608. Signals 602 and 608 are respectively compared in flow controller 608 and controller 608 establishes an output signal 614 responsive to the difference between signals 602 and 606. Signal 614 is provided to control valve 97 and valve 97 is manipulated responsive to signal 614. A setpoint signal (not illustrated) representative of a desired level in column 60 may be manually inputted to level controller 600 by an operator or in the alternative, be under computer control via a control algorithm. Depending on the operating conditions, operator or computing machine logic is employed to determine whether control will be based on liquid level or flowrate. In response to the variable flowrate input of signal 606 and the selected setpoint signal, the controller 608 provides an output signal 614 which is responsive to the difference between the respective input and setpoint signals. This signal is scaled so as to be representative, as the case may be, of the position of the control valve 97 required to maintain the flowrate of fluid substantially equal to the desired flowrate or the liquid level substantially equal to the desired liquid level, as the case may be.

As illustrated in FIG. 2, the overhead stream from column 60 is delivered to high-stage ethylene chiller 42 via conduit 125. The overhead stream undergoes cooling via indirect heat exchange means 44. This partially cooled stream exits chiller 42 via conduit 127. At least a portion of the methane-rich stream in conduit 127 is diverted into conduit 133 through the actions of valves 69 and 532. The undiverted portion of the methane-rich stream continues through conduit 127 to intermediate-stage ethylene chiller 54 where the stream is cooled via heat exchange means 56. The methane-rich stream exits chiller 54 via conduit 129. The diverted portion of the methane-rich stream passes through valve 69 into conduit 135. The portions of the methane-rich streams in conduits 129 and 135 are combined in conduit 131.

The proportion of liquids in the two-phase stream in conduit 131 is preferably controlled by maintaining the streams at a desired temperature. This is accomplished in the following manner. A temperature transducing device 688 in combination with a sensing device such as a thermocouple situated in conduit 131 provides an input signal 686 to a temperature controller 682. Also provided to the controller 682 by operator or computer algorithm is a setpoint temperature signal 684. The controller 682 responds to the differences in the two inputs and transmits a signal 680 to the flow control valve 69 which is situated in a conduit wherein flows the portion of the stream delivered via conduit 127 which does not undergo cooling via heat exchanger means 56 in chiller 54. The transmitted signal 680 is scaled to be representative of the position of the control valve 69 required to maintain the flowrate necessary to obtain the desired temperature in conduit 131.

The methane-rich stream in conduit 131 is delivered to separator 71 where the liquid portion of the methane-rich stream is separated from the gaseous portion of the methane-rich stream. The gaseous portion is removed from separator 71 via conduit 137 and is sent to low-stage ethylene chiller 68. The liquid portion is removed from separator 71 via conduit 139. Cryogenic pump 73 transfers the liquid methane-rich reflux stream to heavies removal column 60 via conduit 141, entering column 60 proximate the top thereof. Preferably, the temperature of the liquid methane-rich stream at pump 73 is between about −80° to −120° F.

The controllers previously discussed may use the various well-known modes of control such as proportional, proportional-integral, or proportional-integral-derivative (PID). In the preferred embodiments for temperature and flow control, a proportional-integral controller is utilized, but any controller capable of accepting two input signals and producing a scaled output signal, representative of a comparison of the two input signals, is within the scope of the invention. The operation of PID controllers is well known in the art. Essentially, the output signal of a controller may be scaled to represent any desired factor or variable. One example is where a desired temperature and an actual temperature are compared by a controller. The controller output could be a signal representative of a change in the flow rate of some fluid necessary to make the desired and actual temperatures equal. On the other hand, the same output signal could be scaled to represent a percentage, or could be scaled to represent a pressure change required to make the desired and actual temperatures equal.

In one embodiment of the present invention, the LNG production systems illustrated in FIGS. 1 and 2 are simulated on a computer using conventional process simulation software. Examples of suitable simulation software include HYSYS™ from Hyprotech, Aspen Plus® from Aspen Technology, Inc., and PRO/II® from Simulation Sciences Inc.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A method of liquefying natural gas, said method comprising the steps of:

(a) cooling the natural gas via indirect heat exchange with a first refrigerant, thereby providing a cooled natural gas stream;

(b) using a heavies removal column to separate the cooled natural gas stream into a lights stream and a heavies stream;

(c) cooling at least a portion of the lights stream via indirect heat exchange with a second refrigerant of different composition than the first refrigerant, thereby providing a cooled lights stream;

(d) separating the cooled lights stream into a predominately liquid phase lights stream and a predominately gas phase lights stream;

(e) introducing at least a portion of the predominately liquid phase lights stream into the heavies removal column; and (f) introducing a portion of the natural gas stream into the heavies removal column as a stripping gas, said heavies removal column including a first inlet for receiving the cooled natural gas stream, a second inlet for receiving the predominately liquid phase lights stream, a third inlet for receiving the stripping gas, a first outlet for discharging the lights stream, and a second outlet for discharging the a heavies stream, said first outlet and said second inlet being vertically disposed above the first inlet, said second outlet being vertically disposed below the first inlet, said third inlet being vertically disposed below the first inlet.

2. A method according to claim 1, said first outlet being vertically disposed above the second inlet, said second outlet being vertically disposed below the third inlet.

3. A method according to claim 1, steps (a)-(f) being carried out in a multi-stage cascade-type liquefied natural gas facility using at least three refrigerants, each having a different composition.

4. A method according to claim 1 further comprising the step of vaporizing liquefied natural gas produced via steps (a)-(f).

5. A method according to claim 1, wherein said multi-stage expansion includes flashing the further cooled lights stream to thereby provide a predominately vapor phase and a predominately liquid phase; and using the predominately vapor phase as the predominately methane refrigerant.

6. A method according to claim 1, said first refrigerant comprising predominately propane, propylene, or carbon dioxide.

7. A method according to claim 1, said first refrigerant comprising predominately propane, said second refrigerant comprising predominately ethylene.

8. A method according to claim 1 wherein a cryogenic pump is used to transfer the predominately liquid phase lights stream to the heavies removal column.

9. A method according to claim 1 wherein the at least a portion of the predominately liquid phase lights stream is used as reflux in the heavies removal column.

10. A method according to claim 1; and (g) introducing at least a portion of the predominately liquid phase lights stream into the heavies removal column.

11. A method according to claim 1; and (h) using at least a portion of the predominately liquid phase lights stream as reflux in the heavies removal column.

12. A method according to claim 1; and (i) vaporizing liquefied natural gas produced via steps (a)-(f).

13. An apparatus for liquefying natural gas, said apparatus comprising:

a first heat exchanger for cooling the natural gas via indirect heat exchange with a first refrigerant;

a heavies removal column positioned downstream of the first heat exchanger and including a first inlet for receiving natural gas, said heavies removal column being operable to separate the natural gas into a lights stream and a heavies stream;

a second heat exchanger for cooling the lights stream via indirect heat exchange with a second refrigerant;

a separator for separating the cooled stream from the second heat exchanger into a predominately gas phase lights stream and a predominately liquid phase lights stream;

an initial heat exchanger positioned upstream of the first heat exchanger and operable to cool the natural gas via indirect heat exchange with the first refrigerant, thereby providing an initially cooled natural gas stream; and a stripping gas heat exchanger for facilitating indirect heat exchange between the initially cooled natural gas stream and the heavies stream, said heavies removal column including a second inlet for receiving the predominately liquid phase lights stream, said heavies removal column including a third inlet for receiving the initially cooled natural gas stream.

14. An apparatus according to claim 13, said first inlet being vertically positioned below the second inlet.

15. An apparatus for liquefying natural gas, said apparatus comprising:

a first heat exchanger for cooling the natural gas via indirect heat exchange with a first refrigerant;

a heavies removal column positioned downstream of the first heat exchanger and including a first inlet for receiving natural gas, said heavies removal column being operable to separate the natural gas into a lights stream and a heavies stream;

a second heat exchanger for cooling the lights stream via indirect heat exchange with a second refrigerant;

a separator for separating the cooled stream from the second heat exchanger into a predominately gas phase lights stream and a predominately liquid phase lights stream; and an initial heat exchanger positioned upstream of the first heat exchanger and operable to cool the natural gas via indirect heat exchange with the first refrigerant, thereby providing an initially cooled natural gas stream, said heavies removal column including a second inlet for receiving the predominately liquid phase lights stream, said heavies removal column including a third inlet for receiving the initially cooled natural gas stream, said first inlet being vertically positioned below the second inlet and above the third inlet.

16. An apparatus according to claim 15, said heavies removal column including a first set of internal packing disposed between the first and second inlets, said heavies removal column including a second set of internal packing disposed between the second and third inlets.

17. An apparatus according to claim 15, said heavies removal column including a first outlet for discharging the lights stream and a second outlet for discharging the heavies stream, said first outlet being vertically positioned above the first inlet, said second outlet being vertically position below the third inlet.

18. An apparatus for liquefying natural gas, said apparatus comprising:

a first heat exchanger for cooling the natural gas via indirect heat exchange with a first refrigerant;

a heavies removal column positioned downstream of the first heat exchanger and including a first inlet for receiving natural gas, said heavies removal column being operable to separate the natural gas into a lights stream and a heavies stream;

a second heat exchanger for cooling the lights stream via indirect heat exchange with a second refrigerant;

a separator for separating the cooled stream from the second heat exchanger into a predominately gas phase lights stream and a predominately liquid phase lights stream;

a third heat exchanger for further cooling at least a portion of the cooled natural gas effluent from the second heat exchanger via indirect heat exchange with the second refrigerant; and a bypass system operable to route at least a portion of the cooled natural gas effluent from the second heat exchanger around the third heat exchanger, said heavies removal column including a second inlet for receiving the predominately liquid phase lights stream.

19. An apparatus according to claim 18, said bypass system including a temperature measuring device and a control valve, said temperature measuring device being operable to generate a temperature signal indicative of the temperature of the cooled natural gas effluent from the third heat exchanger, said control valve being operable to control the amount of natural gas routed around the third heat exchanger based on the temperature signal.

20. An apparatus according to claim 19; and a fourth heat exchanger for cooling at least a portion of the lights stream via indirect heat exchange with the second refrigerant, thereby providing a cooled lights stream.

21. An apparatus according to claim 20; and a fifth heat exchanger for cooling at least a portion of the cooled lights stream via indirect heat exchange with a predominately methane refrigerant, thereby providing a further cooled lights stream.

22. An apparatus according to claim 21, said first refrigerant comprising predominately propane, propylene, or carbon dioxide, said second refrigerant comprising predominately ethane, ethylene, or carbon dioxide.

23. An apparatus according to claim 21, said first refrigerant comprising predominately propane, said second refrigerant comprising predominately ethylene.

24. An apparatus according to claim 21; and a multi-stage expansion cycle operable to cool the further cooled lights stream via sequential pressure reduction.

25. An apparatus according to claim 18; and a cryogenic pump for transferring the predominately liquid phase lights stream from the separator to the second inlet of the heavies removal column.

26. An apparatus according to claim 18, said first and second refrigerants having a different composition.

27. An apparatus according to claim 18, said first refrigerant comprising predominately propane, propylene, or carbon dioxide, said second refrigerant comprising predominately ethane, ethylene, or carbon dioxide.

28. An apparatus according to claim 18, said first refrigerant comprising predominately propane, said second refrigerant comprising predominately ethylene.

29. An apparatus according to claim 18, said apparatus being a cascade-type liquefied natural gas facility having at least three refrigeration cycles, each employing a different refrigerant.

30. An apparatus according to claim 29, said cascade-type liquefied natural gas facility employing an open methane refrigeration cycle.

31. The method according to claim 1, wherein lights stream exiting an upper portion of the heavies removal column and a heavies stream exiting a lower portion of the heavies removal column.

32. The method according to claim 1, wherein cooling at least a portion of the predominately gas phase lights stream in the second refrigeration cycle via indirect heat exchange with the second refrigerant, thereby providing a second cooled natural gas stream.

33. The method according to claim 1, wherein cooling at least a portion of the second cooled natural gas stream in a third refrigeration cycle via indirect heat exchange with a third refrigerant comprising predominately methane.

34. The method according to claim 1, wherein cooling at least a portion of the predominately gas phase lights stream via indirect heat exchange with a predominately methane refrigerant, thereby providing a further cooled lights stream.

35. The method according to claim 1, wherein cooling at least a portion of the further cooled lights stream via multi-stage expansion.

36. The method according to claim 1, wherein said second refrigerant comprises predominately ethane, ethylene, or carbon dioxide.

* * * * *

UNITED STATES PATENT AND TRADEMARK OFFICE

CERTIFICATE OF CORRECTION

PATENT NO. : 7,600,395 B2
APPLICATION NO. : 10/875734
DATED : October 13, 2009
INVENTOR(S) : Eaton et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1179 days.

Signed and Sealed this

Fifth Day of October, 2010

David J. Kappos

David J. Kappos
*Director of the United States Patent and Trademark Office*